US011741921B1

(12) United States Patent
Threlkeld-Wiegand

(10) Patent No.: US 11,741,921 B1
(45) Date of Patent: Aug. 29, 2023

(54) APPARATUS AND METHOD FOR STRINGED INSTRUMENT TAILPIECE

(71) Applicant: Christopher Threlkeld-Wiegand, Iowa City, IA (US)

(72) Inventor: Christopher Threlkeld-Wiegand, Iowa City, IA (US)

( * ) Notice: Subject to any disclaimer, the term of this patent is extended or adjusted under 35 U.S.C. 154(b) by 0 days.

(21) Appl. No.: 17/803,100

(22) Filed: Feb. 8, 2022

(51) Int. Cl.
*G10D 3/13* (2020.01)
*G10D 3/04* (2020.01)
*G10D 1/02* (2006.01)

(52) U.S. Cl.
CPC ..... *G10D 3/13* (2020.02); *G10D 1/02* (2013.01); *G10D 3/04* (2013.01)

(58) Field of Classification Search
CPC ..... G10D 3/13; G10D 1/02; G10D 3/04
See application file for complete search history.

(56) References Cited

U.S. PATENT DOCUMENTS 375,710 A * 12/1887 Lorenz ..... G10D 3/13 84/302
635,347 A * 10/1899 Pearson ..... G10D 1/02 84/303
1,339,196 A * 5/1920 Halstead ..... G10D 3/13 984/118
1,416,568 A * 5/1922 Mazzocco ..... G10D 1/02 267/74
1,757,170 A * 5/1930 Callier ..... G10D 3/13 984/118
1,884,434 A * 10/1932 Wehmann ..... G10D 1/02 984/118
2,971,422 A * 2/1961 Passa ..... G10D 1/02 984/118
3,096,676 A * 7/1963 Havivi ..... G10D 3/13 984/118
3,688,630 A * 9/1972 Tartaglia ..... G10D 3/12 984/118
4,224,857 A * 9/1980 Infeld ..... G10D 1/02 984/118
6,635,812 B2 * 10/2003 Roth ..... G10D 3/13 84/300
7,304,225 B2 * 12/2007 Ricci ..... G10D 1/02 84/302
D658,709 S * 5/2012 Frirsz ..... D17/21
10,199,015 B2 * 2/2019 Tsuruta ..... G10D 3/10
11,328,694 B2 * 5/2022 Canel ..... G10D 3/22
11,501,743 B1 * 11/2022 Threlkeld-Wiegand ..... G10D 3/13
2022/0230606 A1 * 7/2022 Schiebold ..... G10D 3/01

* cited by examiner

*Primary Examiner* — Robert W Horn

(57) ABSTRACT

A stringed instrument tailpiece includes an elongate body. Openings, which may be slots or through-holes, are formed at a bridge-end of the elongate body to engage a musical instrument's one or more strings. An opening at the gut-end of the elongate body is configured to engage a gut, which attaches to an instrument endpin.

18 Claims, 7 Drawing Sheets

APPARATUS AND METHOD FOR STRINGED INSTRUMENT TAILPIECE

RELATED APPLICATIONS

This application is a continuation of U.S. application Ser. No. 16/974,024 filed Sep. 11, 2020 and claims benefit of that application, which is hereby incorporated by reference in its entirety.

BACKGROUND

Inventive concepts relate generally to an apparatus and method for a stringed instrument tailpiece. In particular, inventive concepts relate to an apparatus and method for a stringed instrument tailpiece through which instrument strings that may be bowed or plucked may be terminated in the instrument's endpin.

The violin family of stringed musical instruments, including the violin, viola, and cello, was first developed in Italy in the early 1500s. The general design of such instruments was refined in the 1600s by such well-known makers as the Amati family and Antonio Stradivari. That design survives substantially intact to this day, with relatively minor modifications, for example, to the length and tilt of the fingerboard and to the length of the neck, for example. There is some debate as to whether the double bass is derived from the viol or is a member of the violin family. The double bass's proportions are unlike those of the violin and cello, for example, in that it is proportionately much deeper than a violin and it shoulders are much more sloping than those of the violin. This yields an external appearance more like that of the viola da gamba, but the internal construction of the double bass is nearly identical to that of instruments of the violin family. In any case, all these stringed musical instruments, and more, employ a tailpiece. An improved tailpiece in accordance with principles of inventive concepts may be employed to advantage with any stringed musical instrument, whether in the violin family or not, that requires a tailpiece.

The general construction of a violin family instrument will now be described in reference to the perspective view of a conventional violin of FIG. 1. As previously noted, an apparatus and method in accordance with principles of inventive concepts may be used in conjunction with any stringed musical instrument that employs a tailpiece, whether in the violin family or not. Although example embodiments may be described in reference to violin family instruments, inventive concepts are not limited thereto.

An example of a conventional stringed instrument employing a tailpiece is illustrated in FIG. 1. Although this illustration may apply to any instrument of the violin family of stringed musical instrument, such as violin, viola, cello or double bass, for clarity and conciseness of description, the instrument will be referred to hereinafter, simply, as a violin. Additionally, as noted above, inventive concepts may be applied to any stringed musical instrument that employs a tailpiece.

The violin 100 includes a hollow body 110, neck 120, strings 130, a tailpiece 140 to which ends of strings 130 are fastened, and bridge 150 for transmitting the vibration of the strings 130 to the body 110. The tailpiece 140 attaches, at the opposite end to which the strings are attached, to endpin 118. The term "endpin" is used herein to refer to the element of a stringed instrument, referred to in the violin family of stringed instruments as either an endpin or button and, generally, refers to an element that attaches a gut-end of a tailpiece to the body of the instrument. The body 110 includes an upper plate 112 in which f-shaped holes 124 are formed and a lower plate 114. Side plate 116 connects the upper plate 112 and lower plate 114 to form a hollow resonant body.

Four spaced-apart strings 130 are tensioned on the upper plate of the body 110. The ends of the strings 130 opposite the ends attached to the tailpiece 140 are wound to the pegs 122. Four string holes 142 are formed in the tailpiece and the ends of strings 130 are inserted into these holes and fastened to the tailpiece through the holes. Tailgut 126, traditionally formed of gut cord, are wrapped around endpin 118, with one "leg" (that is, strand, length, cord, cable, etc.) on either side of endpin and both legs returning to tailpiece 140 to be fixed to the tailpiece, thereby fastening the tailpiece 140 to the body 110. Vibrations generated in the strings 130, by plucking or bowing, for example, may be transmitted by the bridge 150 to the resonant body 110 for amplification.

SUMMARY OF THE INVENTION

In example embodiments in accordance with principles of inventive concepts a musical instrument tailpiece includes an elongate body that is top/bottom and left/right symmetrical, openings formed at a bridge-end of the elongate body to engage a musical instrument's one or more strings and an opening at the gut-end of the elongate body to engage a gut.

In example embodiments a tailpiece includes a single-leg gut.

In example embodiments the mass of the elongate body is evenly distributed above and below a plane substantially defined by locations corresponding to the centers of a plurality of instrument string-ends exiting the elongate body through openings at the bridge end and the opening at the gut-end of the elongate body.

In example embodiments openings formed at the bridge-end of a tailpiece are enclosed holes.

In example embodiments openings formed at the bridge-end of a tailpiece are slots.

In example embodiments the separation of the outermost openings on the bridge end of the tailpiece is less than the separation of the corresponding slots, or grooves, on an associated instrument bridge.

In example embodiments the elongate body of a tailpieces comprises a natural material.

In example embodiments the elongate body of a tailpiece is comprises a wood.

In example embodiments the elongate body of a tailpiece comprises a metal.

In example embodiments the elongate body comprises a synthetic material.

In example embodiments the elongate body comprises a carbon fiber material.

In example embodiments the opening at the gut-end of the tailpiece is sized to accommodate no more than one gut-end leg.

In example embodiments a musical instrument tailpiece includes an elongate body that is top/bottom and left/right symmetrical, slot-openings formed at a bridge-end of the elongate body to engage a musical instrument's one or more strings, the slot-openings spaced equidistant apart and substantially along a line that bisects the top and bottom of the elongate body, and an opening at the gut-end of the elongate body to engage a gut.

In example embodiments the length of the elongate body is determined by a proximity to an associated instrument's saddle on one end and the distance from an associated instrument's bridge, the bridge to tailpiece distance determined by a rule of eighteen determination and the saddle to tailpiece distance within a range of from one eighth to two inches.

In example embodiments the saddle to tailpiece distance of a tailpiece is within a range of from one half to one inch.

In example embodiments, the tailpiece is a compensating tailpiece.

BRIEF DESCRIPTION OF THE DRAWINGS

Example embodiments in accordance with principles of inventive concepts will be more clearly understood from the following detailed description taken in conjunction with the accompanying drawings in which.

DETAILED DESCRIPTION

Figure 1:
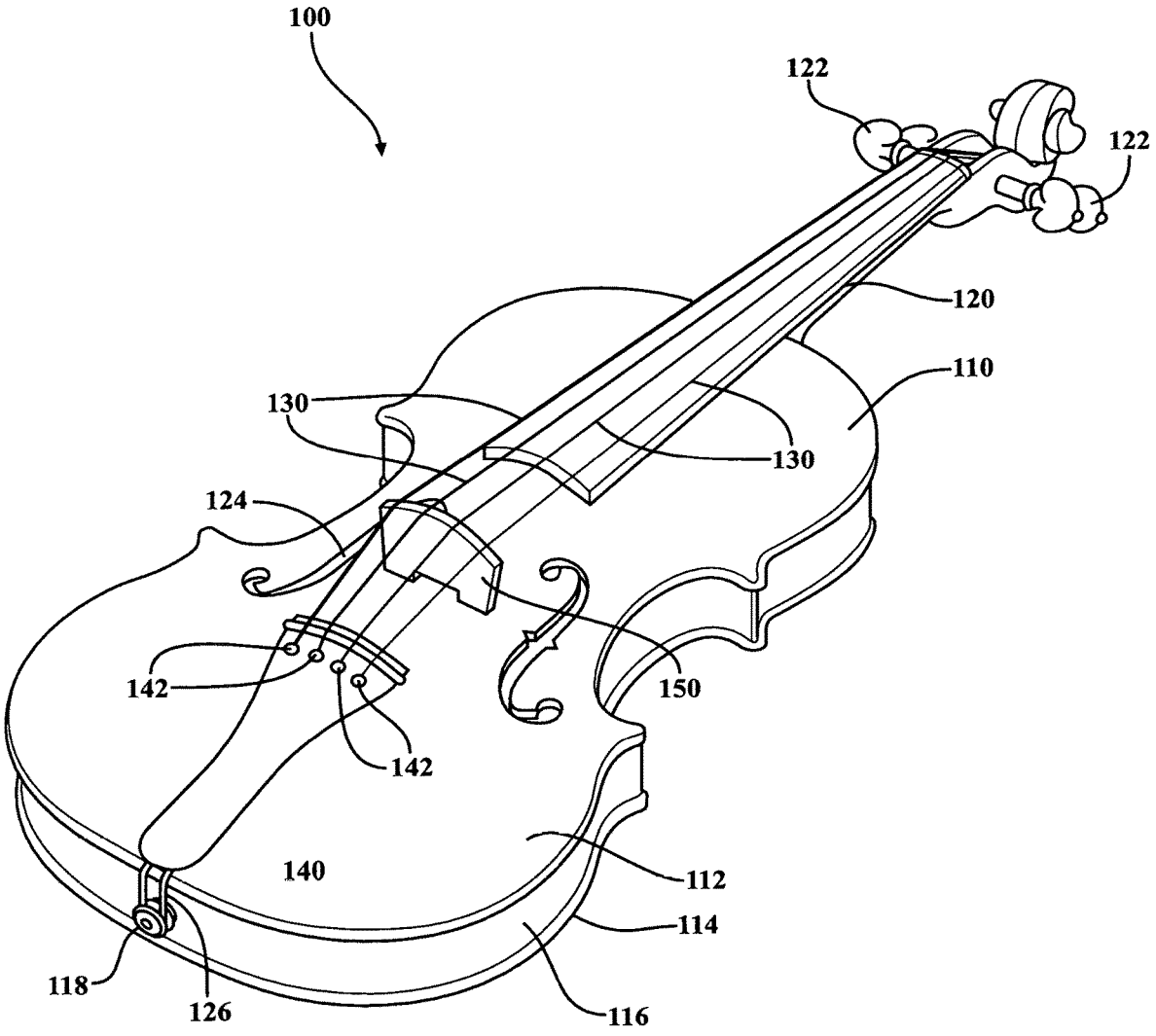
FIG. 1 is perspective view of a conventional violin family stringed instrument.

Example embodiments in accordance with principles of inventive concepts will now be described more fully with reference to the accompanying drawings, in which example embodiments are shown. Example embodiments in accordance with principles of inventive concepts may, however, be embodied in many different forms and should not be construed as being limited to the embodiments set forth herein; rather, these embodiments are provided so that this disclosure will be thorough and complete, and will fully convey the concept of example embodiments to those of ordinary skill in the art. Like reference numerals in the drawings denote like elements, and thus their description may not be repeated. Example embodiments of systems and methods in accordance with principles of inventive concepts will be described in reference to the accompanying drawings and, although the phrase "example embodiments in accordance with principles of inventive concepts" may be used occasionally, for clarity and brevity of discussion example embodiments may also be referred to as "Applicants' system," "the system," "Applicants' method," "the method," or, simply, as a named component or element of a system or method, with the understanding that all are merely example embodiments of inventive concepts in accordance with principles of inventive concepts.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. As used herein the term "or" includes any and all combinations of one or more of the associated listed items. Other words used to describe the relationship between elements should be interpreted in a like fashion (for example, "between" versus "directly between," "adjacent" versus "directly adjacent," "on" versus "directly on"). The word "or" is used in an inclusive sense, unless otherwise indicated.

It will be understood that, although the terms "first", "second", etc. may be used herein to describe various elements, components, regions, layers or sections, these elements, components, regions, layers or sections should not be limited by these terms. These terms are only used to distinguish one element, component, region, step, layer or section from another element, component, region, step, layer or section. Thus, a first element, component, region, step, layer or section discussed below could be termed a second element, component, region, step, layer or section without departing from the teachings of example embodiments.

Spatially relative terms, such as "beneath," "below," "lower," "above," "upper," "top," "bottom," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if an element in the figures is turned over, elements described as "bottom," "below," "lower," or "beneath" other elements or features would then be oriented "atop," or "above," the other elements or features. Thus, the example terms "bottom," or "below" can encompass both an orientation of above and below, top and bottom. The device may be otherwise oriented (rotated 90 degrees or at other orientations) and the spatially relative descriptors used herein interpreted accordingly.

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises", "comprising", "includes" or "including," if used herein, specify the presence of stated features, integers, steps, operations, elements or components, but do not preclude the presence or addition of one or more other features, integers, steps, operations, elements, components or groups thereof. The word "or" is used in an inclusive sense to mean both "or" and "and/or." The term "exclusive or" will be used to indicate that only one thing or another, not both, is being referred to.

Unless otherwise defined, all terms (including technical and scientific terms) used herein have the same meaning as commonly understood by one of ordinary skill in the art to which example embodiments in accordance with principles of inventive concepts belong. It will be further understood that terms, such as those defined in commonly-used dictionaries, should be interpreted as having a meaning that is consistent with their meaning in the context of the relevant art and will not be interpreted in an idealized or overly formal sense unless expressly so defined herein.

For clarity and brevity of description, inventive concepts may be described in terms of example embodiments related to a violin; other stringed musical instruments that employ a tailpiece, such as the double bass, viola, cello, and guitar, are contemplated within the scope of inventive concepts.

The terms first, second, third, etc. may be used herein to describe various elements, components, regions, layers or sections. These elements, components, regions, layers or sections should not be limited by these terms. These terms may be only used to distinguish one element, component, region, step, layer or section from another region, step, layer or section. Terms such as "first," "second," and other numerical terms do not imply a sequence or order unless clearly indicated by the context. Thus, a first element, component, region, step, layer or section discussed below could be termed a second element, component, region, step, layer or section without departing from the teachings of the example configurations.

In example embodiments in accordance with principles of inventive concepts, an apparatus and method in accordance with principles of inventive concepts may join the strings of a stringed musical instrument to the instrument's endpin, a plug (used, for example, on Pollman double basses), or to otherwise attach the strings to the instrument's body.

Figure 2:
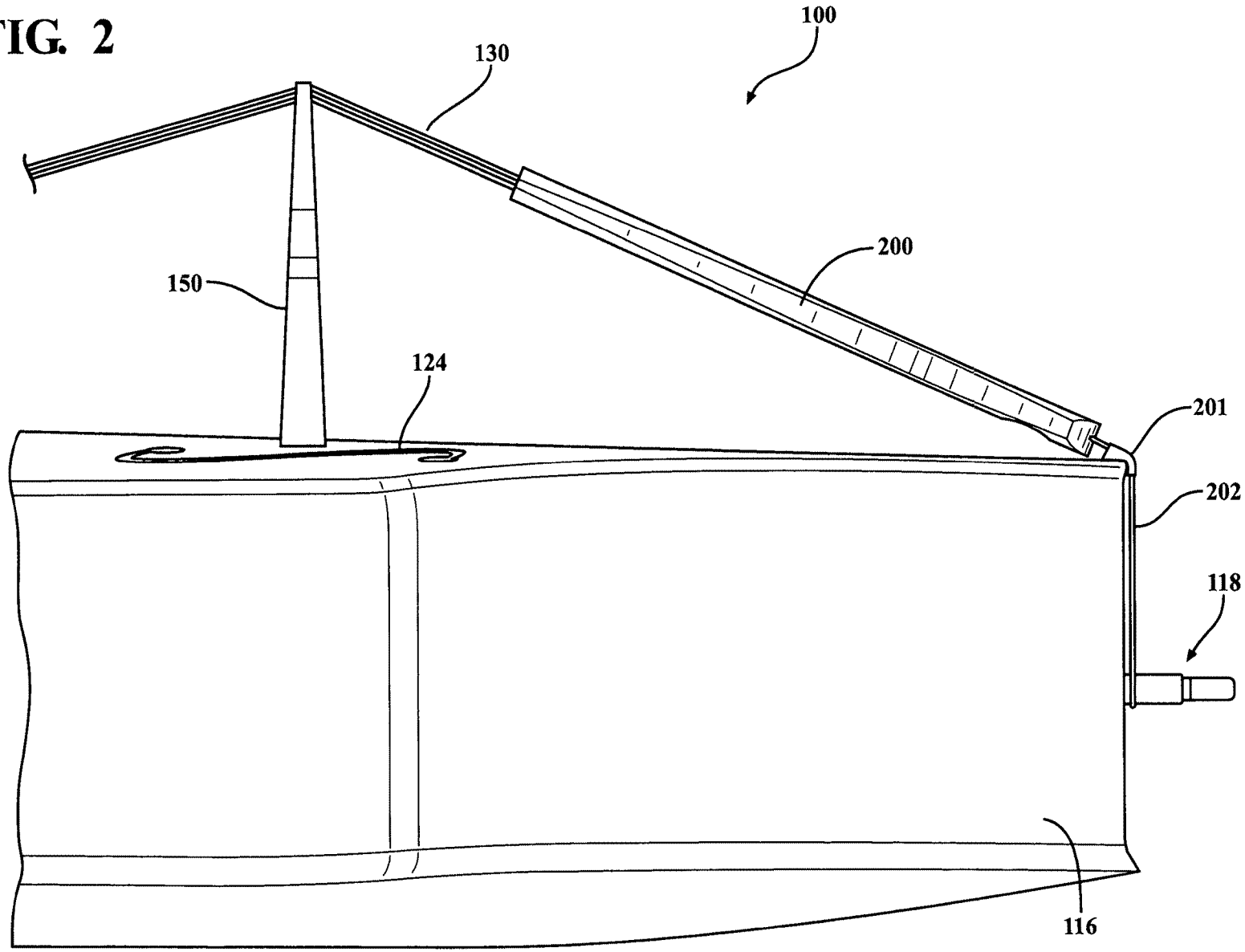
FIG. 2 is a plan view of an example embodiment of a tailpiece in accordance with principles of inventive concepts in place on a violin family stringed instrument.

An example embodiment of an apparatus and method for a stringed musical instrument tailpiece is depicted in the plan view of FIG. 2, in which example embodiment of a tailpiece 200 in accordance with principles of inventive concepts operationally attaches strings 130 of a violin family instrument 100 through tailgut 202, which crosses saddle 201, to endpin 118. Bridge 150, side plate 116 and f hole 124 are as previously described. As will be described in greater detail in the discussion related to FIG. 3A through FIG. 4, in example embodiments the overall contours of tailpiece 200 may be symmetrical about planes that bisect the tailpiece horizontally and vertically. String-holes, or slots, and other openings, or cavities, such as for housing the instruments string-ends or tailgut ends may not be laid out symmetrically. In some embodiments, such as compensating tailpiece embodiments, symmetry may be in only one plane, such as a horizontal plane. In example embodiments a tailgut that attaches the tailpiece to the instrument's endpin may employ a single-leg configuration, as opposed to the conventional dual-leg configuration described above in the discussion related to FIG. 1. That is, a single-leg gut configuration crosses the instrument top, across a saddle for example, with only one leg, as opposed to the traditional two legs. As previously noted, tailgut 202 may engage with endpin 118 or any other securing member associated with violin 100 (a violin "button," for example) in order to secure strings 130 to the resonant body 110 of violin 100. Not wishing to be bound by theory, it is the Applicants' belief that any one of, or any combination of, the symmetry of the tailpiece, the single-leg configuration of the tailgut, and the mid-face egress of the strings from the bridge-end of the tailpiece and mid-face egress of the gut from the gut-end of the tailpiece, by providing more freedom of movement than conventional tailpieces and tailgut combinations, enhances the resonance, sustain, tone, response and playability of the instrument. With strings emerging mid-face and the gut emerging mid-face, tension may be transferred substantially in-line from the bridge, through the tailpiece and on to the saddle and end-pin relatively kink- of binding-free, thereby substantially eliminating or parasitic movement of the tailpiece that may diminish sound quality and volume.

A wolf tone, or "wolf," is a sympathetic artificial overtone that amplifies and expands the frequencies of a played musical note. The wolf is produced when the played note matches the resonant frequency of the violin family instrument being played. Wolfs are undesirable and players employ various apparatus, referred to as wolf tone eliminators to reduce, as much as possible, the effects of a wolf. Wolf eliminators, essentially attenuators, are typically attached to an offending string between the bridge and tailpiece of the instrument. It has been Applicant's experience that wolfs are considerably diminished by use of his novel tailpiece and that, for those wolfs that are not entirely eliminated, a player may "play around" or otherwise compensate for the wolf more readily. Additionally, the sound produced by the instrument appears to be substantially fuller and richer than that produced with a conventional tailpiece.

In example embodiments a violin family tailpiece may be configured to conduct the tensile forces exerted upon the instrument's strings in a substantially linear fashion, across the bridge, through the tailpiece, through the gut, and over the saddle. That is, whether in a through-hole embodiment or a slot embodiment the instrument strings emerge from the bridge-end of the tailpiece substantially in the middle of the tailpiece (middle relative to the plane that bisects the tailpiece in the top/bottom direction) and similarly, the gut emerges from the gut-end of the tailpiece substantially in the middle of the tailpiece. In such embodiments tension is transferred, without skewing or kinking associated with conventional tailpiece arrangements where, for example, strings are routed over the top of the tailpiece. Not wishing to be bound by theory, although the kink, discontinuity, or flow-disruption associated with a conventional tailpiece string termination may appear to be minor, it is Applicant's belief that the interruption-free straight-line path from bridge, through the tailpiece and on to the saddle provided by Applicant's example embodiments may contribute to the greater responsiveness, improved playability, greater sustain, and fuller sound yielded through use of his novel tailpiece. The use of a single-leg gut in accordance with principles of inventive concepts may similarly contribute to such positive attributes.

Any suitable material, including the traditional ebony wood, may be used to construct a tailpiece in accordance with principles of inventive concepts. The use of natural materials, including all variety of wood; metals; or synthetic materials, such as carbon fiber, are contemplated within the scope of inventive concepts. Applicant has found that lighter materials may provide greater response than heavier materials. For example, a carbon fiber embodiment may provide greater responsiveness than an ebony embodiment of the same dimension.

Figure 3A:
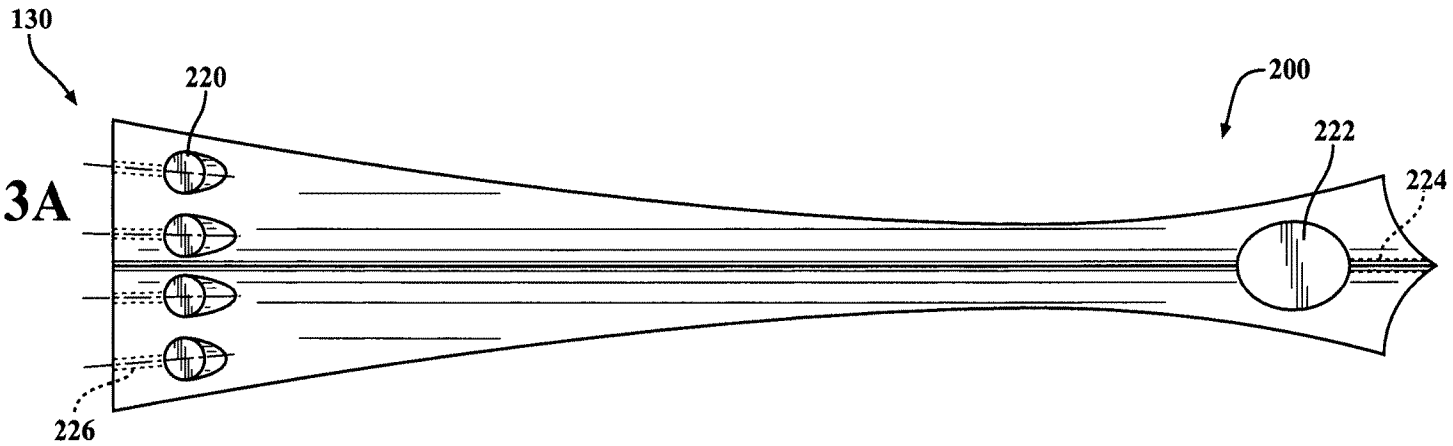
FIGS. 3A, 3B, and 3C are bottom, side and top views of an example embodiment of a violin family tailpiece in accordance with principles of inventive concepts.
Figure 3B:
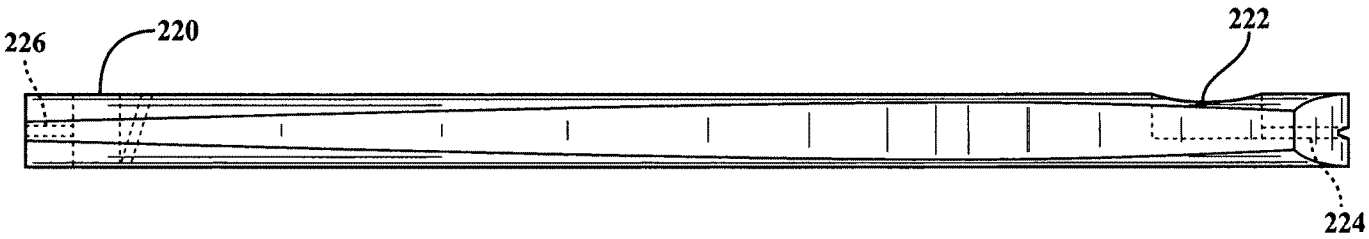
Figure 3C:
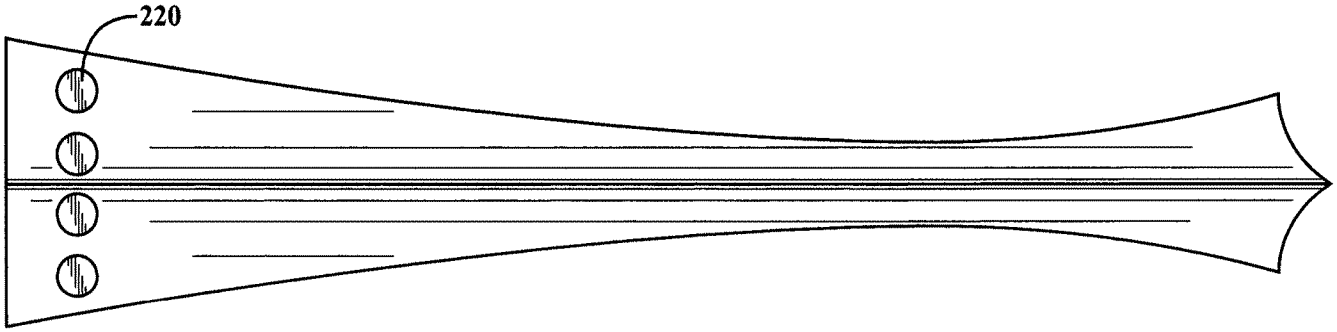

FIGS. 3A, 3B, and 3C are, respectively, bottom, side, and top views of an example embodiment of a tailpiece in accordance with principles of inventive concepts. Tailpiece 200 is an elongate apparatus that is, in its overall outline, substantially symmetric about a plane perpendicular to the plane of the page ("coming out" of the page of FIG. 3A) and delineated in the figure by points A and A' in FIG. 4. Tailpiece 200 is also substantially symmetric about the plane of the page in FIG. 3A, and about a plane perpendicular to the page ("coming out" of the page of FIG. 3A), marked by point B and B' in FIG. 4. Points A and A' may be referred to herein as defining a primary, left/right axis and points B and B' may be referred to herein as defining a secondary, top/bottom axis, with "top" referring to the side of a tailpiece positioned opposite the top side of the instrument and "bottom" facing the instrument, and "left" being the left side of the tailpiece as viewed when viewing the front of the instrument (with tailpiece in place). In example embodiments, the mass of a tailpiece in accordance with principles of inventive concepts may be evenly distributed above and below the primary axis and to the left and to the right of the secondary axis. In example embodiments, the top/bottom and left/right symmetry of the tailpiece and positioning of string holes and gut hole substantially within the same plane (with the exception of slight out-of-plane placements for string holes that reflect or mirror bridge arcs in some embodiments) provides such even mass distribution.

The bottom plan view of FIG. 3A includes openings 220, which are configured to receive and hold string-ends that, typically, include ball-ends to hold the string ends in place under tension. Other methods of holding the string ends in place within openings 220, such as loops, are contemplated within the scope of inventive concepts. Recess 222 formed in the distal end (the end away from strings 130 and toward endpin 118) is configured to accept one end of tailgut 202 and to retain that tailgut end therein. Tailgut through-hole 224 (depicted in broken lines) provides a channel for the tailgut 126 from recess 222 to endpin 118 or other attachment member located on violin body 110. Similarly, string through-holes 226 (depicted in broken lines) provide channels for violin strings from openings 220 toward the violin bridge 150, neck 120, etc. In this example embodiment, string cavities 220 penetrate the entire thickness of tailpiece 200 and are visible in the top plan view of FIG. 3C. In example embodiments one end of tailgut 126 may be threaded through tailgut through-hole 224 and crimped or otherwise configured (for example, expanded as with a toggle bolt or other expansion mechanism). The opposite end of the tailgut may be looped around the violin attachment member (endpin 118, for example) and crimped back on itself for attachment to the violin attachment member. In example embodiments, a tailgut may be pre-formed with an expansion end for insertion into tailgut through hole 224 and with a single leg terminated in a loop for attachment around the violin attachment member.

Other embodiments are contemplated within the scope of inventive concepts. For example, a tailgut may be formed sans loop, and threaded and attached through the instrument endpin. Some violin family instruments, notably the double bass, come in a variety of sizes and shapes. That is, although violins are of a substantially standard size and shape, double basses vary considerably and may be of a certain size to accommodate a larger or smaller player, for example. The proportion of the bass components may vary from instrument to instrument as well, with some double basses having larger lower bouts than others. Nevertheless, bass tailpieces are typically selected from among a few size options, with ¾ size tailpiece being approximately 13.5 inches in length. As a result, several inches of the gut extending from the tailpiece to the saddle may be exposed.

In example embodiments in accordance with principles of inventive concepts, a bass tailpiece may be of a length that accommodates the distance between an individual bass bridge and saddle: custom fit, that is, for the length. The distance from the bridge to the bridge-end of the tailpiece may be configured according to a method such as "the rule of 18," which is known in the art. For a double bass, the distance between bridge and tailpiece may be set such that the "E" string is tuned to "A" at the bridge-end of the tailpiece, in general, the distance is set such that the lowest string is tuned to the next higher open string. In example embodiments, a tailpiece may extend substantially from the tuned distance near the bridge to within a short range of the saddle. The tailpiece is configured such that it is not so long as to contact the instrument top while playing, yet near enough to the saddle that only a relatively short length of gut extends from the gut-end of the tailpiece to the saddle. In example embodiments that exposed length of gut may be less than two inches; in some embodiments that length is less than one inch; in some embodiments that length is less than one half inch.

Figure 4:
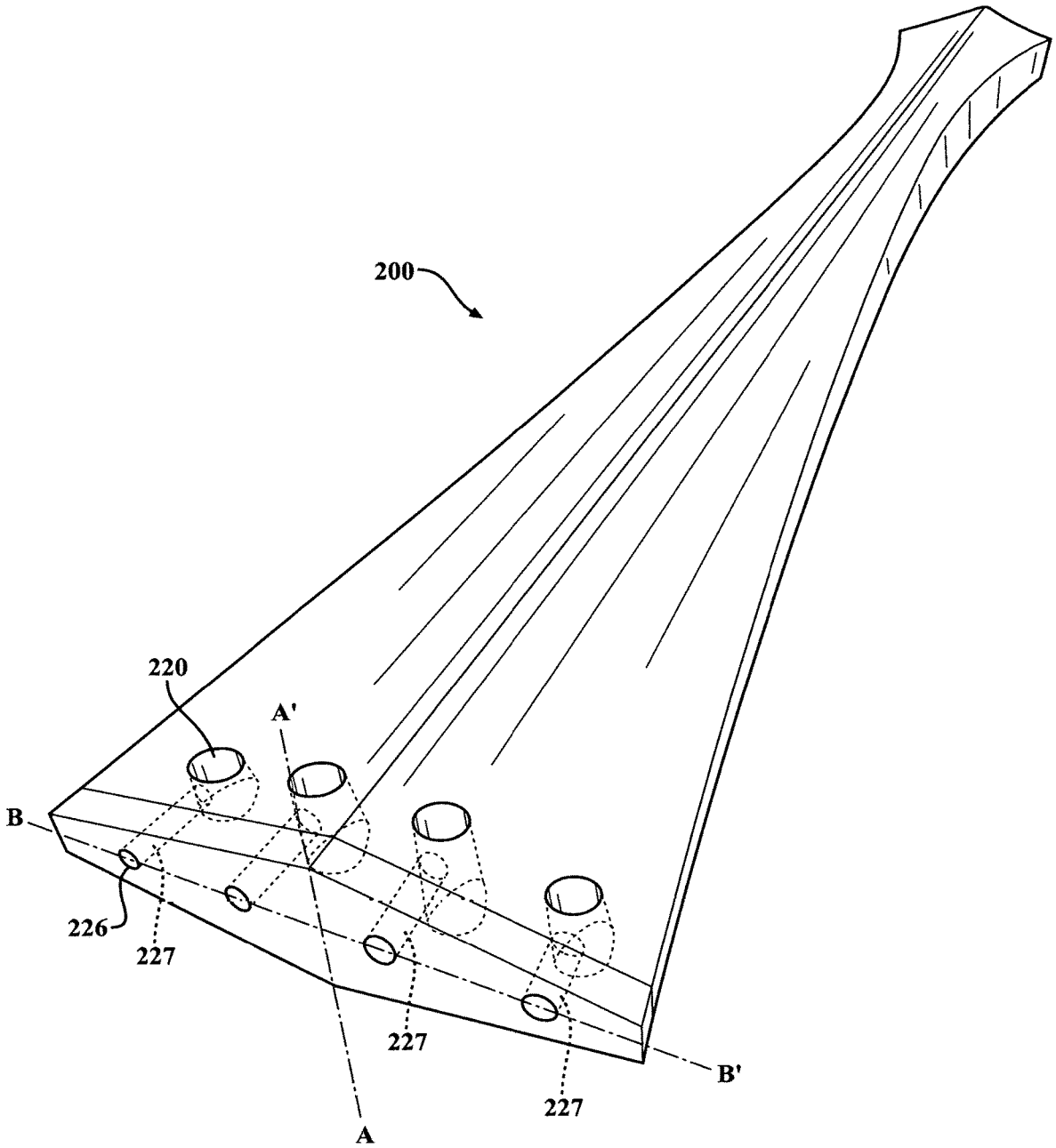
FIG. 4 is a perspective view of an example embodiment of a tailpiece in accordance with principles of inventive concepts.

The perspective view of FIG. 4 illustrates elements of example embodiments of a tailpiece 200 in accordance with principles of inventive concepts. String through-holes 226 receive strings, which are fixed at the tailpiece end within string cavities 220 using, for example, a string ball-end. String cavities may be through and through the tailpiece or may, as denoted by the broken line of this figure, only partially penetrate tailpiece 200. In this example embodiment four string cavities 220 associated with four string through-holes 226 accommodate four strings of a stringed musical instrument. In example embodiments a tailpiece in accordance with principles of inventive concepts may accommodate five strings, with additional string through-hole 226B and string cavity 220B placed to maintain symmetry. In example embodiments, one or more grooves, or slots, 227 may be formed in tailpiece 200 to facilitate rapid insertion or removal of a string. For example, a bassist may wish to switch from a four-string to a five-string configuration (or vice versa) by adding a string to (or removing a string from) string hole 226B. Slot 227 allows the bassist to easily slip the string in (or out), without requiring the threading of the string through string through hole 226B. In example embodiments any or all of the string through-holes 226 may have a slot 227 associated with them to allow easy addition or removal of a string. In example slotted embodiments a tailpiece may not include through-holes 226 and may be configured with a slot 227 and cavity 220B to receive and engage a string and associated ball-end, respectively. Such embodiments are described in greater detail in the discussion related to FIGS. 6A through 6C.

Figure 5:
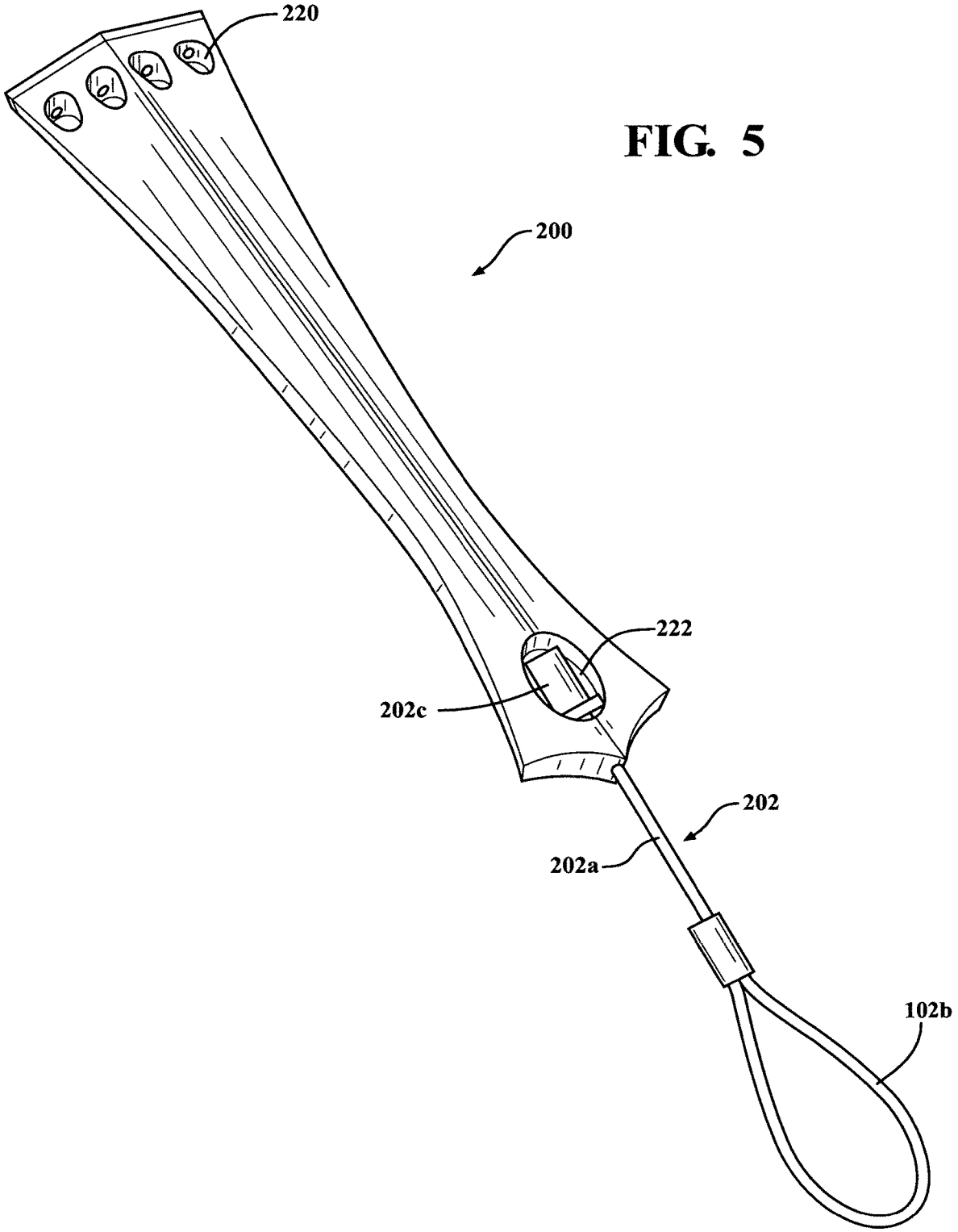
FIG. 5 is a bottom view of an example embodiment of a tailpiece/gut combination in accordance with principles of inventive concepts.

The bottom plan view of FIG. 5 illustrates a tailpiece 200 in accordance with principles of inventive concepts engaged with a single-leg tailgut 202 in accordance with principles of inventive concepts. In this example embodiment. In this example embodiment, tailgut 202 includes a loop 202*b* and single leg 202*a* with a tailpiece end 202*c* terminated within recess 222. As previously indicated, the single leg 202*a* crosses the instrument top, for example, across a saddle, and engages the gut-end of the tailgut through an opening in the gut-end. In example embodiments, loop 202*b* engages the instrument endpin (or button) on the other end and the loop engages exclusively with the endpin; no portion of the loop extends far enough to contact the instrument body and only a single leg 202*a* contacts the instrument through a saddle, for example, as illustrated in greater detail in the perspective view of FIG. 7.

Figure 6A:
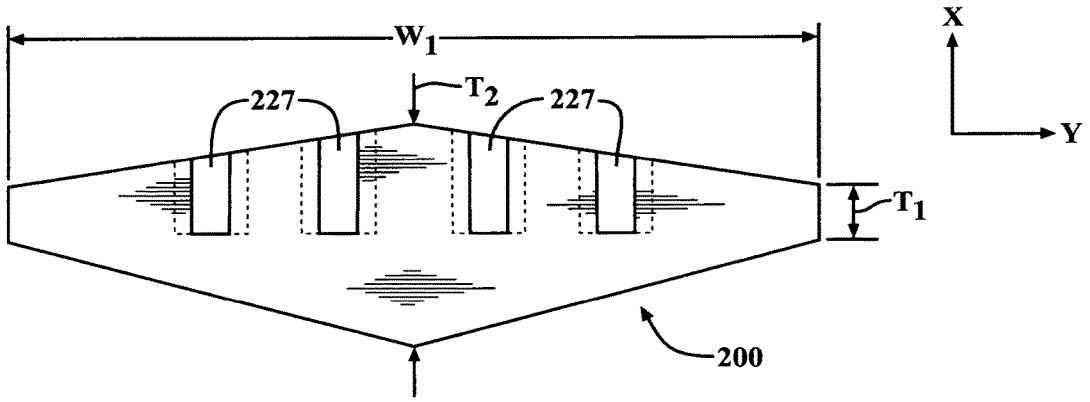
FIGS. 6A, 6B, and 6C are bridge-end, gut-end and perspective views of an example embodiment of a tailpiece in accordance with principles of inventive concepts.
Figure 6B:
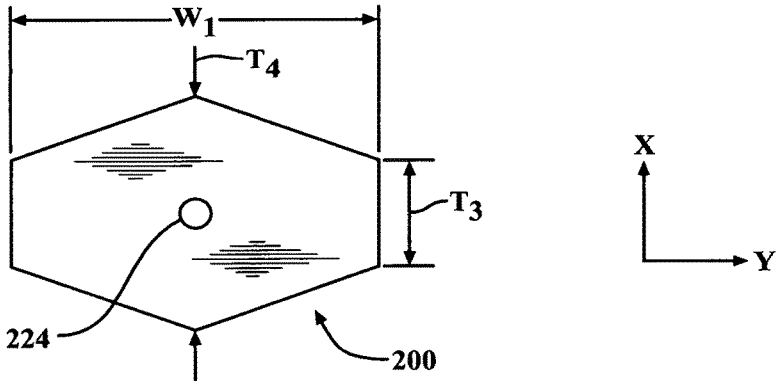

Elements of a slotted, through-hole free, example embodiment of a tailpiece in accordance with principles of inventive concepts will now be described in the discussion related to FIGS. 6A through 6C. FIG. 6A is a view of an example embodiment, viewing the bridge end of the tailpiece end-on; FIG. 6B is a view of an example embodiment, viewing the gut end of the tailpiece end-on; and FIG. 6C is a perspective view illustrating the positioning of string with ball end 131 in a slot of a tailpiece in accordance with principles of inventive concepts.

In an example embodiment of FIG. 6A, slots 222 are arranged so that strings emerging from them are situated substantially in the middle of the tailpiece 200 in the "X" direction. In this example embodiment the thickness of the tailpiece varies from ¼ inch at edge thicknesses T1 to ⅞ inch at middle thickness T2. In an example embodiment, the width W1 at the bridge-end is 3 1/16 inches. These dimension values are given purely as examples and may vary greatly in accordance with principles of inventive concepts. Although slots 222 are shown in-line, they may be arranged with a slight arc to either reflect or mirror the arc of an associated instrument bridge. It should be noted that, in this illustration, the slots are open in the positive "X" direction and, in practice, the slots may be positioned so that they open either toward or away from the instrument, for aesthetic reasons, the slots maybe open toward the instrument in order to hide the string ball-ends from view.

In an example embodiment of FIG. 6B, gut through-hole 224 is positioned in the center of the tailpiece gut-end. In this example embodiment the thickness of the tailpiece varies from ½ inch at edge thicknesses T3 to ⅞ inch at middle thickness T4. In an example embodiment, the width W2 at the gut-end is 1⅞ inches. These dimension values are given purely as examples and may vary greatly in accordance with principles of inventive concepts.

Figure 6C:
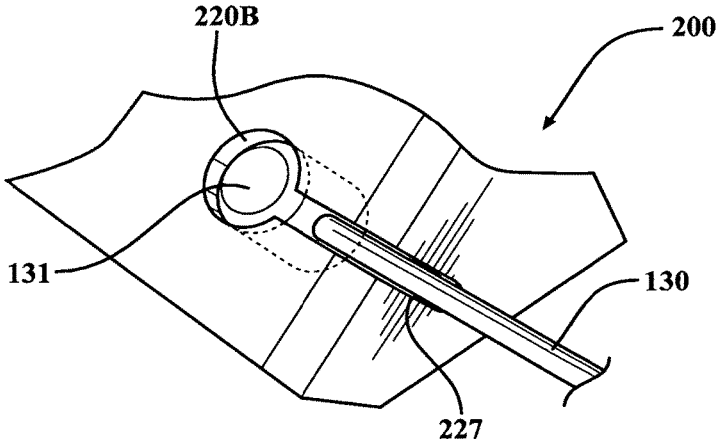

The perspective view of FIG. 6C provides an illustration of a ball 131 and associated string 130 positioned within cavity 220B and slot 227, respectively. Some violin family instruments employ "finer tuners" that are constructed and arranged to allow for the fine tuning of strings between a tailpiece and bridge. A fine tuner in accordance with principles of inventive concepts for use with a slotted embodiment (that is, a tailpiece with cavities for receipt of ball-ends, but no through-holes) may include a mechanism for engagement with a cavity 220B at one end and a mechanism for engagement with an adjuster at another end. The adjuster, such as a turnbuckle, for example, may be situated between a string (with ball-end or loop) and engaged with slot 227/cavity 220B combination on the other end.

Figure 7:
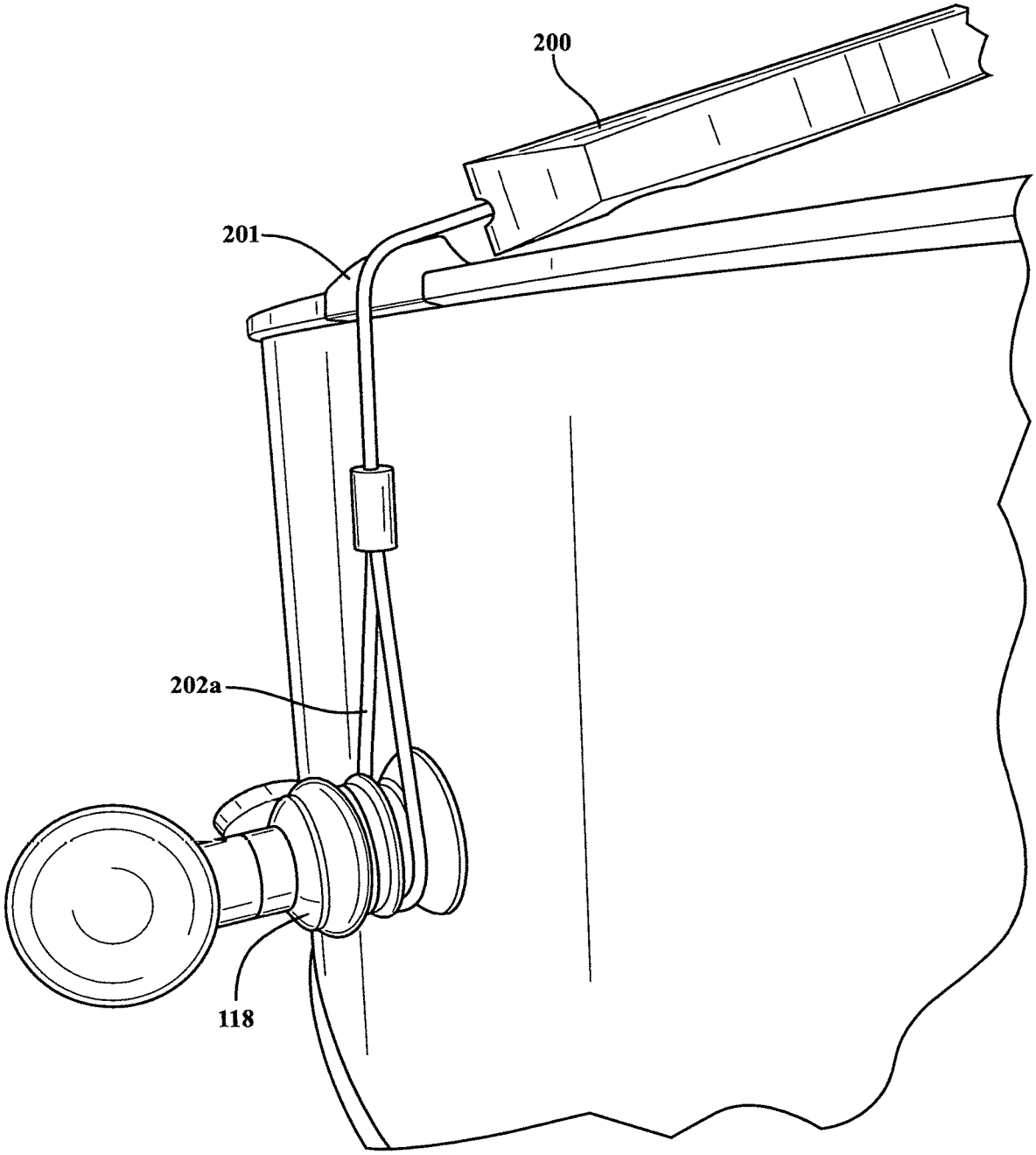
FIG. 7 is a perspective view of an example embodiment of a tailpiece in accordance with principles of inventive concepts, with a single-leg gut engage between the tailpiece and an instrument's endpin.

The perspective view of FIG. 7 illustrates an example embodiment of a tailpiece 200 in accordance with principles of inventive concepts with a single-leg 202*a* gut looped around endpin 118 traveling across saddle 201 and engaged with tailpiece 200 at its gut end. As is evident from this illustrative embodiment, single-leg gut 202*a* only makes contact with the instrument top through saddle 201 and only through a single leg (as opposed to conventional two-leg tailgut 126 as illustrated in FIG. 1.

While the present inventive concepts have been particularly shown and described above with reference to example embodiments thereof, it will be understood by those of ordinary skill in the art, that various changes in form and detail can be made without departing from the spirit and scope of inventive concepts as defined by the following claims.

What is claimed is:

1. A musical instrument tailpiece, comprising:

an elongate body;

at least one opening formed at a bridge-end of the elongate body to engage a musical instrument's one or more strings, wherein at least one channel is configured to convey a musical instrument string from an opening through a portion of the elongate body and out through the face of the bridge-end; and an opening at the gut-end of the elongate body to engage a gut.

2. The musical instrument tailpiece of claim 1, wherein the channel is a slot.

3. The musical instrument tailpiece of claim 1, wherein the channel is a through-hole.

4. The musical instrument tailpiece of claim 1, wherein the opening at the gut-end is a through hole.

5. The musical instrument tailpiece of claim 4, wherein the opening at the gut-end is configured to accommodate a single-leg gut.

6. The musical instrument tailpiece of claim 1, wherein the bridge end includes a plurality of openings the separation of which is less than the separation of the corresponding slots on an associated instrument bridge.

7. The musical instrument tailpiece of claim 1, wherein the elongate body comprises a natural material.

8. The musical instrument tailpiece of claim 1, wherein the elongate body comprises a synthetic material.

9. A musical instrument tailpiece, comprising:

an elongate body;

at least one opening formed at a bridge-end of the elongate body to engage a musical instrument's one or more strings; and an opening through the face of the gut-end of the elongate body to engage a gut, wherein the opening is a through hole.

10. The musical instrument tailpiece of claim 9, wherein the opening at the gut-end is configured to accommodate a single-leg gut.

11. The musical instrument tailpiece of claim 9, wherein the opening at the bridge-end is a slot.

12. The musical instrument tailpiece of claim 9, wherein the opening at the bridge-end is a through-hole.

13. A musical instrument tailpiece, comprising:

an elongate body;

slot-openings formed at a bridge-end of the elongate body to engage a musical instrument's one or more strings; and an opening at the gut-end of the elongate body to engage a gut, wherein the opening is a single through-hole configured to accommodate a single-leg gut.

14. A stringed musical instrument, comprising:

a tailpiece including:

an elongate body;

slot-openings formed at a bridge-end of the elongate body to engage a musical instrument's one or more strings; and an opening at the gut-end of the elongate body to engage a gut; and a single-leg gut connecting the gut-end of the elongate body to an endpin of the stringed musical instrument.

15. The musical instrument of claim 14, wherein the bridge end includes a plurality of openings the separation of which is less than the separation of the corresponding slots on an associated instrument bridge.

16. The musical instrument of claim 14, wherein the elongate body comprises a natural material.

17. The musical instrument of claim 14, wherein the elongate body comprises a synthetic material.

18. The musical instrument tailpiece of claim 14, wherein the length of the elongate body is determined by a proximity to an associated instrument's saddle on one end and the distance from an associated instrument's bridge, the bridge to tailpiece distance determined by a rule of eighteen determination and the saddle to tailpiece distance within a range of from one eighth to two inches.

* * * * *